US007017317B2

(12) United States Patent
Capozzo

(10) Patent No.: US 7,017,317 B2
(45) Date of Patent: Mar. 28, 2006

(54) DECORATIVE CEILING PANEL AND FASTENING SYSTEM

(76) Inventor: Leonard Thomas Capozzo, 27840 Forester Dr., Bonita Springs, FL (US) 34134

( * ) Notice: Subject to any disclaimer, the term of this patent is extended or adjusted under 35 U.S.C. 154(b) by 58 days.

(21) Appl. No.: 10/264,418

(22) Filed: Oct. 4, 2002

(65) Prior Publication Data

US 2004/0065036 A1 Apr. 8, 2004

(51) Int. Cl.
*E04B 9/00* (2006.01)

(52) U.S. Cl. ..... 52/506.07; 52/127.12; 52/220.6; 52/733.1

(58) Field of Classification Search ..... 52/506.06, 52/506.07, 483.1, 489.1, 489.2, 127.12, 127.7, 52/314, 315, 316, 747.1, 745.13, 745.06, 52/733.1, 311.3, 385, 384, 506.7, 220.6
See application file for complete search history.

(56) References Cited

U.S. PATENT DOCUMENTS

| | | | | |
|---|---|---|---|---|
| 383,050 | A | | 5/1888 | Guastavino |
| 407,604 | A | | 7/1889 | Morton |
| 741,593 | A | | 10/1903 | Ryan et al. |
| 3,583,522 | A | | 6/1971 | Rohweder et al. |
| 3,828,506 | A | | 8/1974 | Phillips |
| 3,998,020 | A | * | 12/1976 | Kuhr et al. ..... 52/506.07 |
| 4,189,888 | A | * | 2/1980 | Blitzer, Jr. ..... 52/506.07 |
| D274,757 | S | | 7/1984 | Beaty, Sr. |
| 4,720,946 | A | * | 1/1988 | Pagliarello ..... 52/39 |
| 4,747,246 | A | * | 5/1988 | Sanborn ..... 52/506.07 |
| D299,870 | S | | 2/1989 | Jennings |
| 5,433,048 | A | * | 7/1995 | Strasser ..... 52/288.1 |
| D364,932 | S | | 12/1995 | Tinen |
| 5,603,193 | A | * | 2/1997 | Koertge et al. ..... 52/506.07 |
| 5,609,007 | A | | 3/1997 | Eichner |
| 5,836,127 | A | | 11/1998 | Clark et al. |
| 5,845,447 | A | * | 12/1998 | Bodine et al. ..... 52/506.09 |
| 5,860,257 | A | | 1/1999 | Gerhaher et al. |
| 6,205,732 | B1 | | 3/2001 | Rebman |

* cited by examiner

*Primary Examiner*—Naoko Slack
(74) *Attorney, Agent, or Firm*—Wood, Herron & Evans, L.L.P.

(57) ABSTRACT

A ceiling system is disclosed which has the desirable aesthetic features of a decorative ceiling without the disadvantages of custom fabrication or other types of pre-manufactured ceiling systems. The ceiling system utilizes a plurality of pre-manufactured, modular decorative panels and a fastening system with a snap in mechanism that permits the panels to be installed vertically from below and which minimizes the visibility of the supporting fastening system.

8 Claims, 6 Drawing Sheets

DECORATIVE CEILING PANEL AND FASTENING SYSTEM

FIELD OF THE INVENTION

This invention relates generally to ceiling panels and, more specifically, to a system adapted to be used for installing pre-manufactured decorative ceiling panels.

BACKGROUND OF THE INVENTION

Decorative ceilings, such as traditional coffered ceilings, have been popular in buildings since early Roman times. Utilizing grids of supporting and non-supporting beams, coffers were used as a way to enhance the appearance of a heavily beamed ceiling. With deep supporting beams traveling in one direction, and non-supporting beams traveling perpendicular, architects of the past were able to form sunken boxes or "coffers" on the ceilings of residences, churches, and public buildings. To further decorate these ceilings, wood or plaster trim was added to these boxes or coffers, along with intricate carvings and paint finishes. These elaborate ceiling designs were formed by skilled artisans working many long hours to carve, apply and finish various sculptural effects from many different materials.

Although the look of decorative ceilings of various types are popular in today's more luxurious homes, hotels, and public buildings, the costs can be prohibitive. In the twenty first century, finding skilled artisans to recreate such details is difficult and costly. Also, if time is a factor, many projects cannot afford the additional weeks or months needed for the necessary labor.

In the past there have been some alternative modular or otherwise pre-manufactured decorative ceilings. One system utilized panels of stiffened fabric, such as canvas, with embossed three-dimensional design characteristics (see for example U.S. Pat. No. 407,604 to Morton). Another method was that of the so-called Victorian "tin ceiling" where shallow designs were stamped in metal tiles which were then nailed to the existing ceiling or the ceiling supports. (U.S. Pat. No. 741,593 to Ryan and Sagendorph). Although some of these methods are attractive, they do not properly reproduce aesthetic properties such as deep boxed recesses, heavy beam work, trim details and other desirable features. Moreover, they do not provide such features in a manner which is cost effective from both manufacturing and installation standpoints.

Another decorative ceiling system is a suspended ceiling. Suspended ceiling systems have enjoyed tremendous success in the commercial and residential environments due to their low cost, ease of installation, and versatility to adapt to most room configurations. Furthermore, suspended ceilings increase energy efficiency, improve acoustics, enhance aesthetic value, provide means to adjust ceiling location, and permit easy installation of various electrical fixtures, pipes, sprinkler systems, and duct work. Suspended ceilings utilize a grid system comprised of a series of horizontal runners with perpendicular runners joined at regularly spaced intervals to support generally rectangularly shaped panels typically with a planar visible surface, although some companies are offering embossed, coffered, or raised panel designs.

A common grid configuration is the so called inverted T-Bar that provides support for a panel as it is lowered down into the grid structure from above. It is common to suspend the grid system by a wire connected to a pre-existing ceiling or exposed framing member as a way to control the ceiling height. It is possible, however, to attach the grid directly to the ceiling or framing member with the understanding that there must be sufficient room to maneuver a panel onto the supporting grid from above.

A feature inherent in the T-Bar design is that the panels must be installed onto the grid system from above. This makes the installation of a suspended ceiling more time consuming and difficult. Furthermore, there must be sufficient room between the grid system and the pre-existing roof or exposed framing members to permit a panel to be placed on top of the grid structure and lowered into place. This may be particularly important and potentially problematic in rooms with limited height. Another feature inherent in the T-Bar grid is that the bottom of the "T" is readily visible as part of the ceiling design, a characteristic that many find undesirable in enhancing the aesthetic value of a room. Methods to reduce the obtrusive nature of this feature include coloring the visible portion to match the panel color, or covering the base of the T with a decorative adhesive that is more readily incorporated into the overall ceiling design. Moreover, suspended ceilings enjoy limited success when the panels have deep cavities. The ceiling height would be dramatically reduced due to the need for room above the panel necessary during installation. Also the grid system can usually only support a panel of a particular size, usually no larger than 24×48 inches.

In view of the above problems and drawbacks with custom on-site fabrication, embossed tiles and current suspended ceiling designs, it would be desirable to provide a modular ceiling panel system that utilizes individual decorative panels and a fastening system to achieve a desired decorative look while simultaneously achieving benefits related to low manufacturing and installation costs and increased ceiling height even with panels having deep recesses.

SUMMARY OF THE INVENTION

The intent of the present invention is to achieve the desirable aesthetic features of a decorative ceiling by pre-manufacturing panels that are easy to install, and do not have the disadvantages of custom fabrication or other types of ceiling systems.

In one aspect, the invention utilizes pre-manufactured decorative panels and preferably a fastening system that permits the panels to be installed with a force applied upwardly from below to achieve a snap fit. The fastening system preferably minimizes the visibility of the supporting fastening system. In that regard, the present invention provides for a plurality of decorative panels which may be three-dimensional or flat. The decorative panels are prefabricated and are preferably lightweight. The panels may be made from a variety of materials including wood, foam, plastic, metal, glass reinforced plastic, or preferably fiberglass reinforced gypsum. Those of ordinary skill in the art will further recognize additional materials suitable for manufacturing the ceiling panels.

The panels may be connected directly to an existing ceiling or to exposed framing members such as trusses or rafters. The plurality of panels may be placed in contact with adjacent panels so that their side walls or edges abut each other. A facing strip may then be used to cover the seam between adjacent panels.

The preferred embodiment of the ceiling system provides for a substantially perpendicular fastening system that allows the panels to be quickly and easily snapped into place with a force applied upwardly from below. The fastening system may be attached directly to an existing ceiling or exposed framing members or, alternatively, may be suspended from the existing ceiling or exposed framing member for low-ceiling applications. The fastening system is preferably designed to allow the placement of the panels to snap in from below so as to waste little or no space between the existing ceiling and the fastening system. Since the fastening system is located above the installed panel, visibility of the fastening system is minimized.

The present invention may be advantageously used in low ceiling applications. For environments that have low ceilings, a coffered or other deep cavity ceiling panel configuration may be used to give the appearance of a higher ceiling and thus a larger room. In these applications, the dry wall may be removed from the ceiling, exposing the underlying framing structure. The panels can be configured such that the recessed portions of the panel fit between the trusses or beams of the substructure. In this way, several inches of added height exist along a substantial portion of the ceiling, leaving only the beam portions of the coffered design at a lower height. This provides an overall impression of a larger room.

The preferred fastening system comprises a top and bottom member which when engaged, securely fasten a panel into place. In one embodiment, the top member has i) a substantially flat fascia adaptable for mounting to a substructure; ii) a side wall that extends downwardly from the outward end of the fascia; and iii) a substantially perpendicular flange directed inwardly from the side wall. The bottom member has i) a first vertical side wall; ii) a substantially flat fascia extending outward; iii) a second vertical side wall; and iv) a substantially perpendicular flange directed inwardly from the second vertical side wall. A decorative ceiling panel attaches to the bottom member along the flange so that the panel's side wall abuts the second vertical side wall of the bottom member. The first vertical side wall has a plurality of flexible retaining tabs attached to the side wall so that one end remains attached to the side wall and the other end extending outward at some angle. A weather strip, or some form of compressible material with a spring like memory, is attached to the upper surface of the outward directed fascia so as to provide a snug fit between the top and bottom members upon engagement. To attach the panel, an installer applies a force in the upward direction. The opened tab of the bottom member engages the flange of the top member. The applied force deforms the tab forcing it inward and allowing the panel to move upward. Once the retaining tab clears the flange of the top member, it snaps opens once again and engages the upper surface of the top member's flange. In order for the tab to open, the weather strip is compressed, creating a restoring force that keeps the panel securely in place.

One alternative embodiment is to have a prefabricated case box where the bottom member of the fastening system and the decorative panel are preassembled. The case box has i) a first vertical side wall; ii) a substantially flat fascia extending outward; iii) a second vertical side wall; and iv) a substantially perpendicular flange directed inwardly from the second vertical side wall. A decorative ceiling panel attaches to the flange so that the panel's side wall abuts the second vertical side wall. A retaining tab is attached to the outside surface of the first vertical side wall. The retaining tab can be made of a flexible material, for example, with the top portion extending upwardly and inwardly over the top of the first vertical side wall. The bottom portion of the retaining tab extends downwardly and outwardly at some angle with respect to the first vertical side wall. To connect the case box to the substructure, it is preferable to have a substantially perpendicular fastening system which when engaged by the case box, securely fastens the case box into place. The fastening system comprises a top member that has i) a substantially flat fascia adaptable for mounting to a substructure; ii) a side wall that extends downwardly from the outward end of the fascia; and iii) a flange directed inwardly that is angled at substantially the same angle as the bottom portion of the retaining tab. To attach the case box, an installer applies a force in the upward direction. The top surface of the bottom portion of the retaining tab engages the angled flange of the fastening system. Additionally, the top surface of the top portion of the retaining tab engages the fascia. The applied force deforms the bottom portion of the retaining tab decreasing the angle the tab makes with the first vertical side wall while at the same time deforming the top portion of the retaining tab. Once the bottom portion of the retaining tab clears the angled flange, the tab opens so that the bottom surface of the tab abuts the top surface of the angled flange. The top portion of the retaining tab, however, remains deformed creating a restoring force that provides a snug fit between the case box and fastening system.

In another embodiment, the height of the case box or decorative panel may be adjusted to ensure uniform placement and, therefore, a level overall ceiling height. Preferably, at least one screw adjustment mechanism is coupled between the case box or decorative panel and the top member. More than one screw adjustment mechanism may be provided on each case box or decorative panel. For example, one may be placed adjacent each corner of a square panel. Rotation of the screw(s) in opposite directions moves the case box or decorative panel in opposite directions, i.e., up and down, to achieve the proper height. If the screw is completely disengaged, the case box or decorative panel can be easily removed from the fastening system.

These and other features, objects and advantages of the invention will become more readily apparent to those of ordinary skill in the art upon review of the following detailed description, taken in conjunction with the accompanying drawings.

DETAILED DESCRIPTION OF THE DRAWINGS

Figure 1:
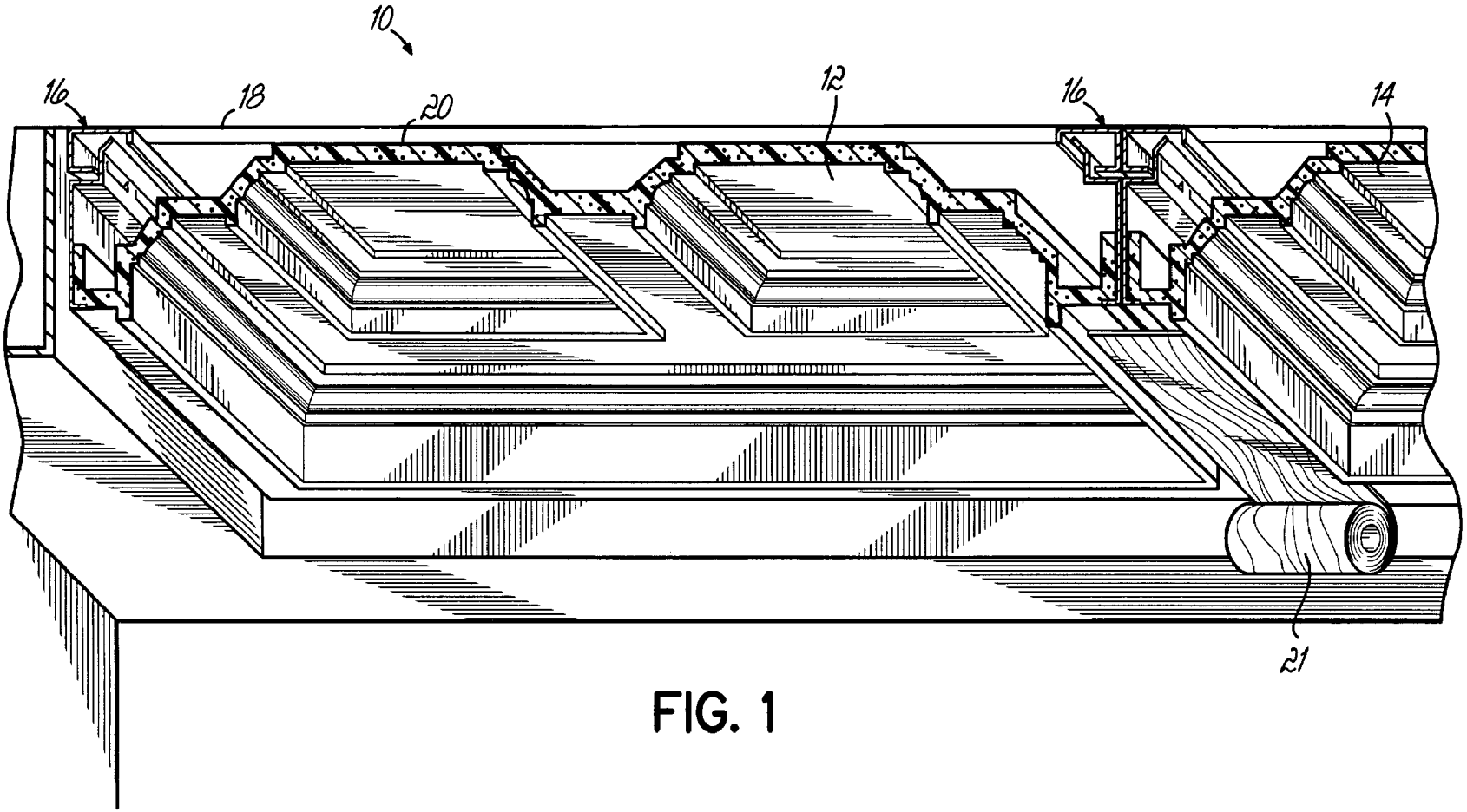
FIG. 1 is a schematic of a ceiling panel system having a plurality of coffered panels attached to a fastening system that allows the panels to quickly and easily snap into place.

Referring first to FIG. 1, a ceiling panel system 10 is schematically illustrated and generally comprises a plurality of coffered ceiling panels 12, 14 that are securely attached to a substantially perpendicular grid or fastening system 16 to simulate a continuous coffered ceiling design. Many other types of decorative ceiling panels may be used in carrying out this invention. The fastening system is attached directly to a substructure 18 that may be a preexisting ceiling or other exposed framing members like trusses or rafters. The fastening system is designed to allow the placement of the panels 12, 14 to install with a force directed upwardly from below. Preferably, a snap fit connection is sued. A facing strip 21 may then be applied to the seam between adjacent panels 12 and 14. The panels may be made from a variety of materials including, e.g., wood, foam, plastic, metal, glass reinforced plastic, or preferably fiberglass reinforced gypsum. In the preferred embodiment, the panels are 48 inches square and 12 inches deep. Of course, any dimensions suitable to the application may be used and the panels may be flat or have concavities of any desired depth. Because the panels attach from below, the distance between the substructure 18 and the top outside surface 20 of the ceiling panels 12, 14 is minimized. This is distinctly different from traditional suspended ceilings since in this invention, little or no clearance is necessary above the fastening system, yet a deep cavity may be formed into the panel.

Figure 2:
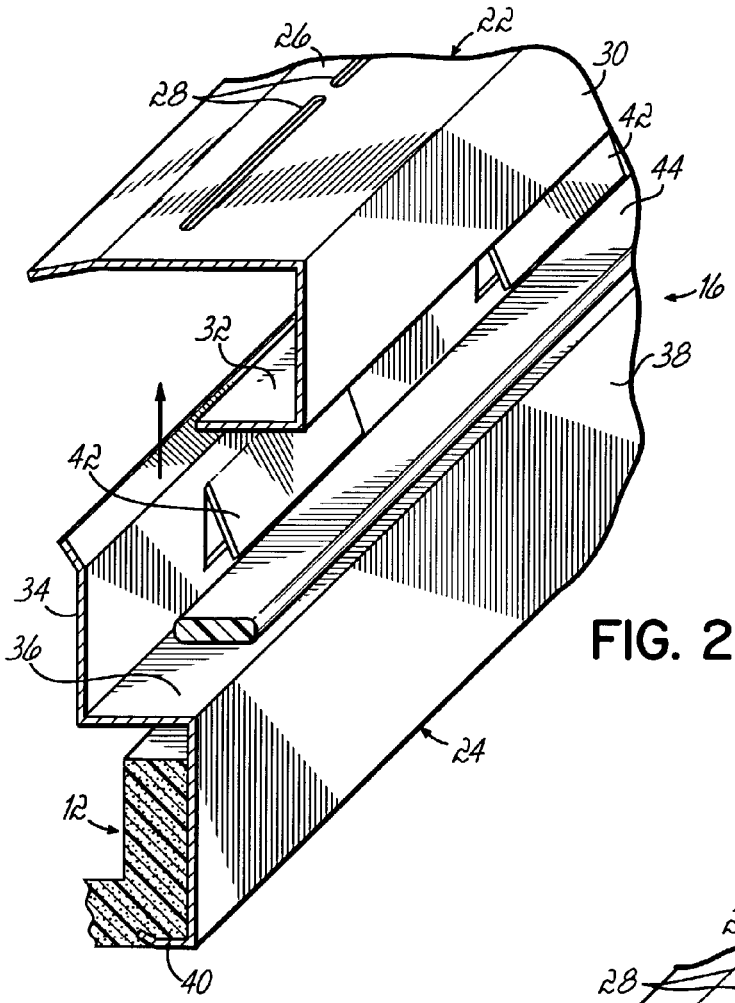
FIG. 2 is a perspective view of a preferred embodiment of the snap in panel and fastening system before engagement.

One embodiment of the fastening system 16 is shown in FIG. 2. It will be appreciated that the same fastening system 16 is used on at least opposite sides of respective panels 12, 14 as illustrated in FIG. 1. Fastening system 16 is comprised of a top and bottom member 22, 24. The top member 22 has a substantially flat fascia 26 adaptable for mounting to the substructure 18. The fascia has a plurality of slots or holes 28 used to mount the top member 22 to substructure 18. A side wall 30 extends downwardly from the outer end of the fascia and is substantially perpendicular to the fascia. A flange 32 extends inwardly from the bottom end of the side wall. The bottom member 24 has a first substantially vertical side wall 34. A substantially flat fascia 36 extends outward substantially perpendicular from the bottom end of the first side wall. A second vertical side wall 38 extends downwardly from the outer end of the fascia 36. A substantially perpendicular flange 40 extends inwardly from the bottom end of the second side wall 38. A decorative ceiling panel 12 attaches to the bottom member 24 along the flange 40 so that a side wall of panel 12 abuts the inside surface of the second vertical side wall 38. The first vertical side wall 34 has a plurality of flexible retaining tabs 42 attached to the side wall such that the top end of the tab is attached to the side wall and the bottom end extending outwardly forming a surface at some angle with respect to the first side wall 34. To provide a snug fit between the panel and the fastening system, a weather strip or other spring like material 44 is attached on the upper surface of the fascia 36.

Figure 3:
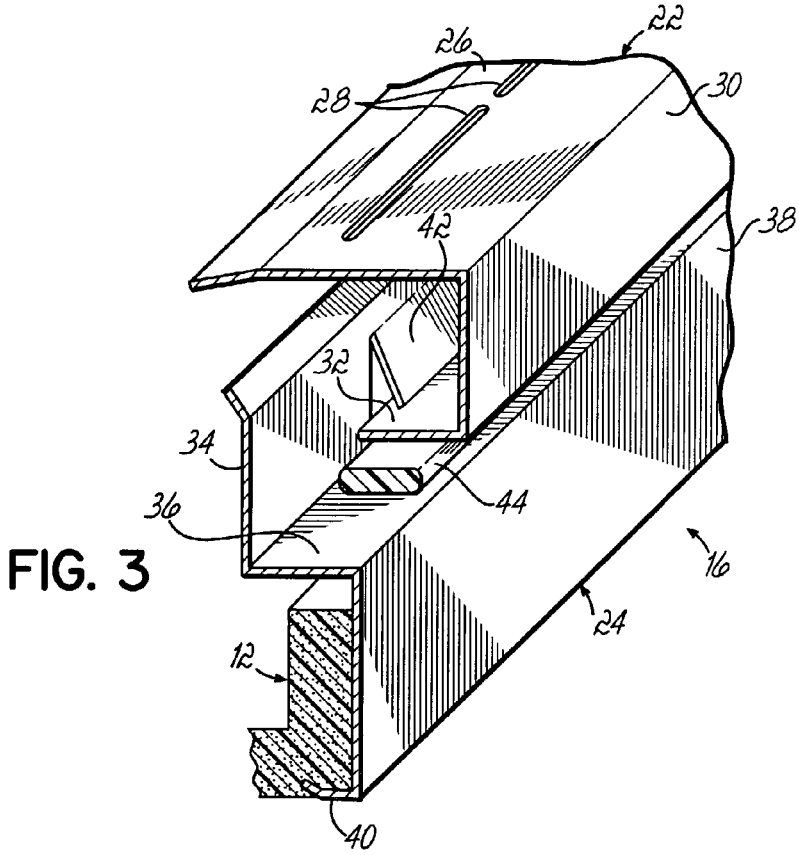
FIG. 3 is a perspective view of the panel and fastening system of FIG. 2 after the top and bottom members are engaged and the panel is secured into place.

To attach a panel to the fastening system, an installer aligns a panel 12 with fastening systems 16 on each side (or all sides) and applies a force in the upward direction. The angled portion of retaining tabs 42 engage the flange 32. The applied force deforms the retaining tabs 42 eventually allowing the panel to move upward when the tab 42 is aligned with the first side wall 34. Once the retaining tab 42 clears the flange 32, the tab 42 opens up contacting the flange 32 along its upper surface. When the two members are engaged and the retaining tab 42 has opened up, the weather strip 44 is compressed between the top surface of the fascia 36 and the bottom surface of the flange 32. This compression creates a restoring force that keeps the panel 12 securely in place. FIG. 3 shows the top and bottom members 22, 24 after they have been engaged and illustrates that a coffered ceiling panel 12 may be installed without wasting any space above the top surface of the panel 12.

Figure 4:
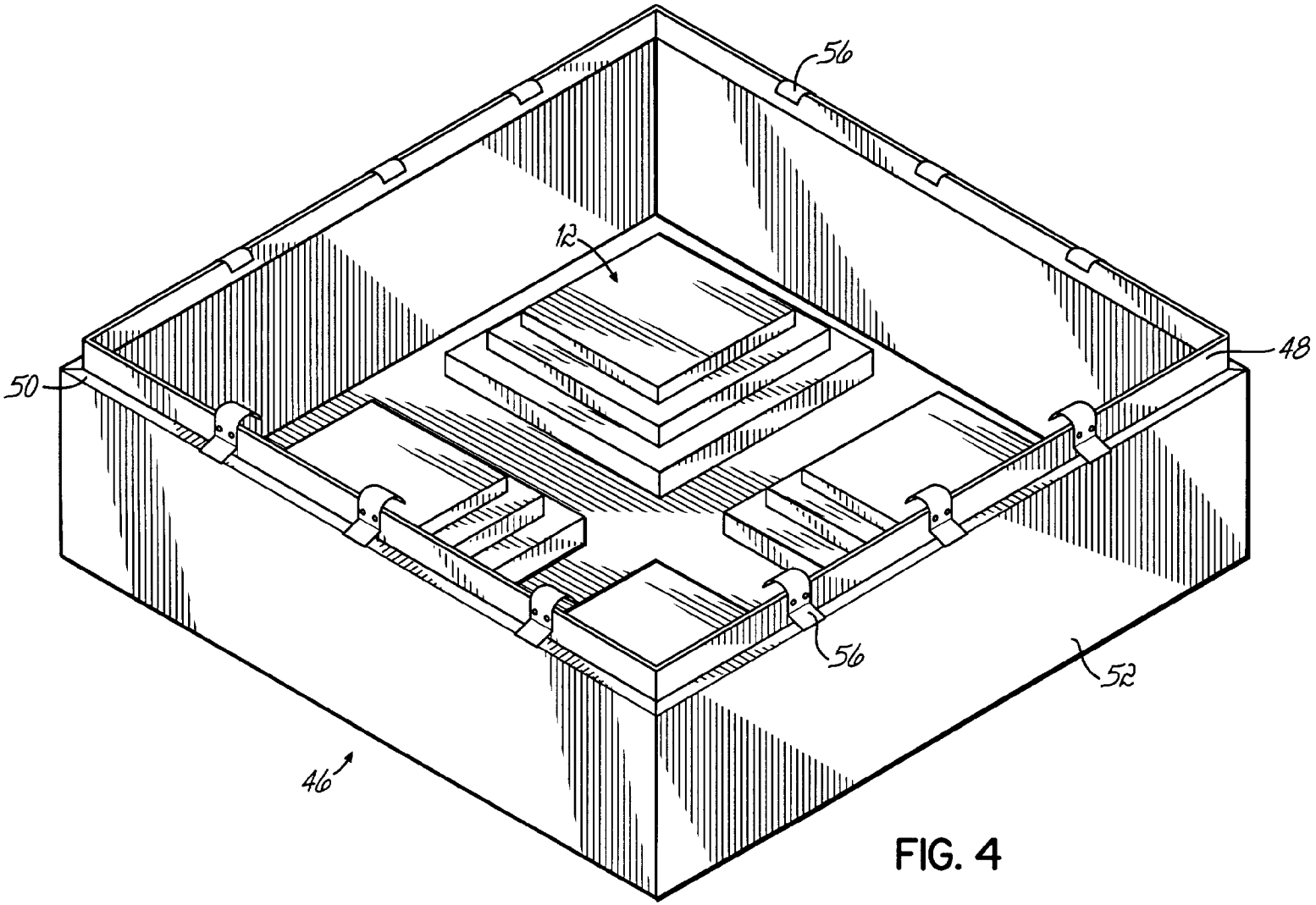
FIG. 4 is a perspective view of another embodiment showing a prefabricated case box where the decorative panel and the bottom member of the fastening system are preassembled.
Figure 5:
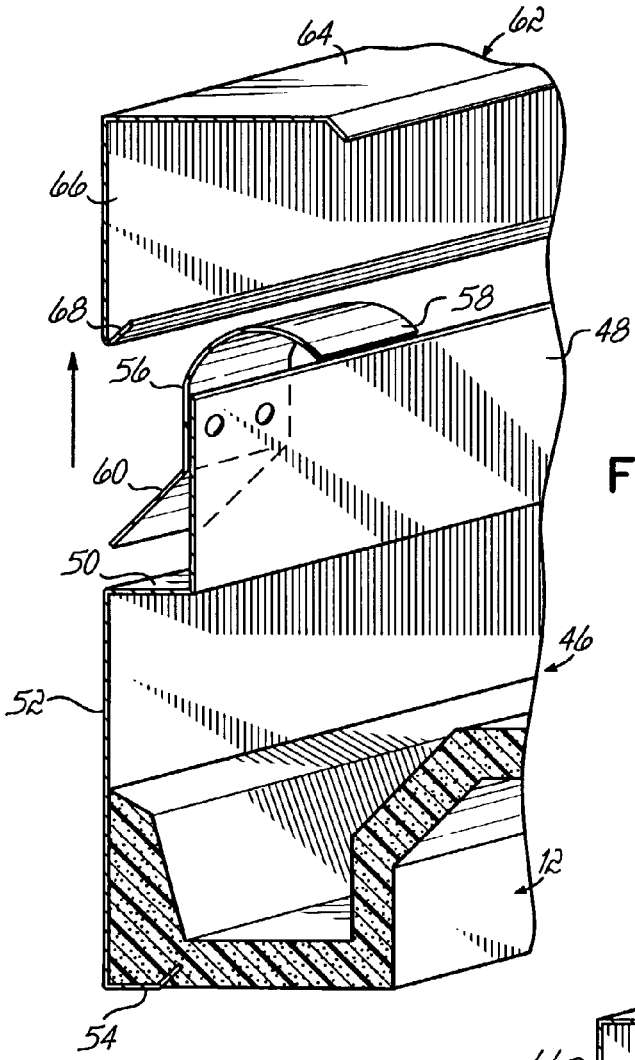
FIG. 5 is a perspective view of an embodiment of the snap in case box and fastening system before engagement.
Figure 6:
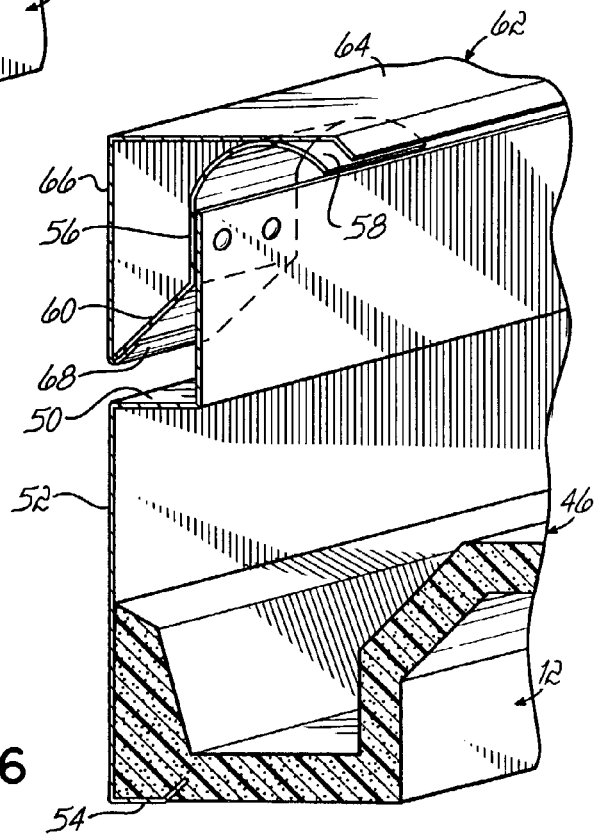
FIG. 6 is a perspective view of the case box and fastening system of FIG. 5 after the case box and fastening system are engaged and the case box is secured into place.

Another embodiment of the present invention is shown in FIGS. 4–6. In this embodiment, a case box 46 is preassembled for quick and easy installation. The case box 46 has a first substantially vertical side wall 48. A substantially flat fascia 50 extends outward substantially perpendicular from the bottom end of the first side wall. A second vertical side wall 52 extends downwardly from the outer end of the fascia 50. A substantially perpendicular flange 54 extends inwardly from the bottom end of the second side wall 52. A coffered or otherwise decorative ceiling panel 12 attaches to the case box 46 along the flange 54 so that a side wall of panel 12 abuts the inside surface of the second vertical side wall 52. A plurality of retaining tabs 56 are attached to the outside surface of the first side wall 48. The retaining tabs 56 are made of a flexible material and have a top end 58 extending upwardly and inwardly over the top of the first side wall 48. The bottom end of the retaining tab 60 is planar and extends downwardly and outwardly at some angle with respect to the first vertical side wall 48. In this embodiment, the case box 46 attaches to a substantially perpendicular fastening system comprising a top member 62. The top member 62 has a substantially flat fascia 64 adaptable for mounting to the substructure 18. A side wall 66 extends downwardly from the outer end of the fascia 64 and is substantially perpendicular to the fascia 64. A flange 68 extends inwardly and upwardly from the bottom end of the side wall 66 at an angle substantially equal to the angle made by the bottom end of the retaining tab 60. As shown, the fastening system described may be used on all sides of case box 46, or at least on opposite sides.

To attach case box 46 to the fastening system, an installer aligns case box 46 with the top member 62 and applies a force in the upward direction. The top surface of the bottom end of retaining tab 60 engages the angled flange 68. Additionally, the retaining tab 58 engages the bottom surface of the fascia 64. The applied force deforms the bottom end of the retaining tab 60 decreasing the angle the tab 60 makes with the side wall 48 while at the same time deforming the top end of the retaining tab 58. Once the bottom end of the retaining tab 60 clears the angled flange 68, the tab 60 opens up so that the bottom of the tab 60 abuts the top surface of the angled flange 68. The top end of the retaining tab 58, however, remains deformed creating a restoring force that keeps the panel 12 securely in place. FIG. 6 shows the case box and fastening system after they have been engaged.

Figure 7:
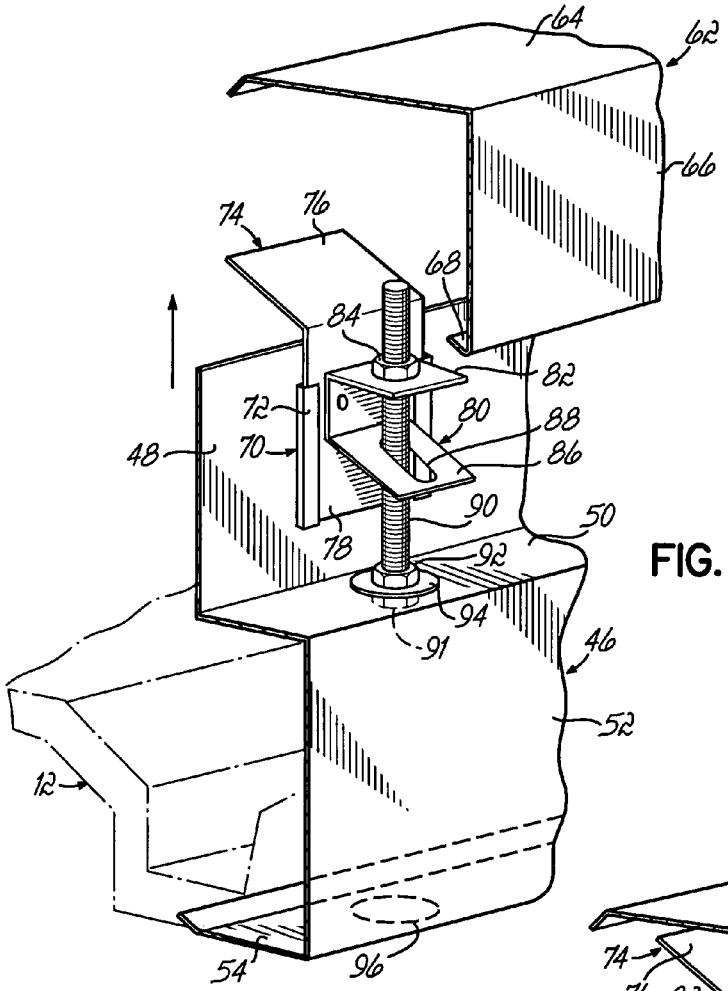
FIG. 7 is a perspective view of a case box and fastening system with an adjustable fastening system before engagement.

In another embodiment of the present invention, the decorative panel or case box is height adjustable. Referring to FIG. 7, the case box 46 and fastening system 62 of FIG. 5 are shown but the case box 46 includes an adjustment mechanism 70. As one illustrative example of such an adjustment mechanism, a vertically oriented track 72 is attached to the outside surface of the first vertical side wall 48. A tab 74 made of a flexible material has a top end 76 extending upwardly and inwardly over the top of the first side wall 48. The tab 74 also has a flat bottom end 78 that moves vertically relative to track 72. A securing clip 80 is attached to the outside surface of the bottom end 78 of the tab 74. The top end of the clip 82 is an outwardly extending flange substantially perpendicular to the bottom end 78 of the tab 74. The flange 82 provides a threaded insert 84. The bottom end 86 of clip 80 is planar and extends downwardly and outwardly at some angle with respect to the first vertical side wall 48. The bottom end 86 has a slot 88 formed therethrough. A threaded screw 90 extends vertically through fascia 50 of case box 46, through slot 88 of the bottom end 86 of clip 80, and into the threaded insert 84 on flange 82 of clip 80. Screw 90 has a screw head 91 and washer (not shown) on one side of fascia 50 and a nut 92 and washer 94 are placed on the opposite side of fascia 50.

The case box 46 is attached to the fastening track 62 as before by applying a force in the upward direction. The top surface of the bottom end 86 of the clip 80 engages the angled flange 68 of the fastening system 62. The applied force deforms the bottom end of the clip 80, decreasing the angle the bottom end 86 makes with the side wall 48. Once the bottom end 86 of clip 80 clears the angled flange 68, it opens up and abuts the top surface of the angled flange 68.

Figure 8:
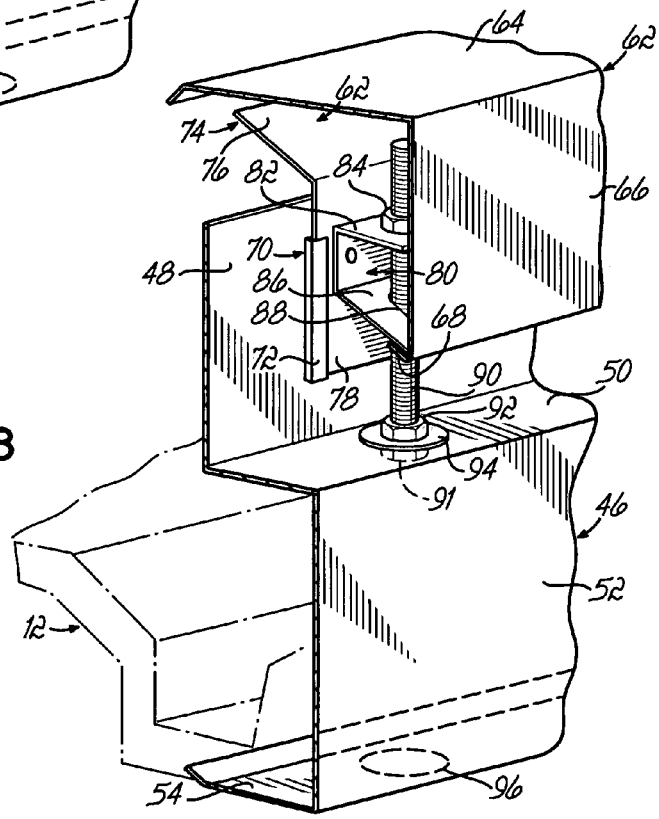
FIG. 8 is a perspective view of the case box and fastening system of FIG. 7 after the case box and fastening system are engaged.
Figure 9:
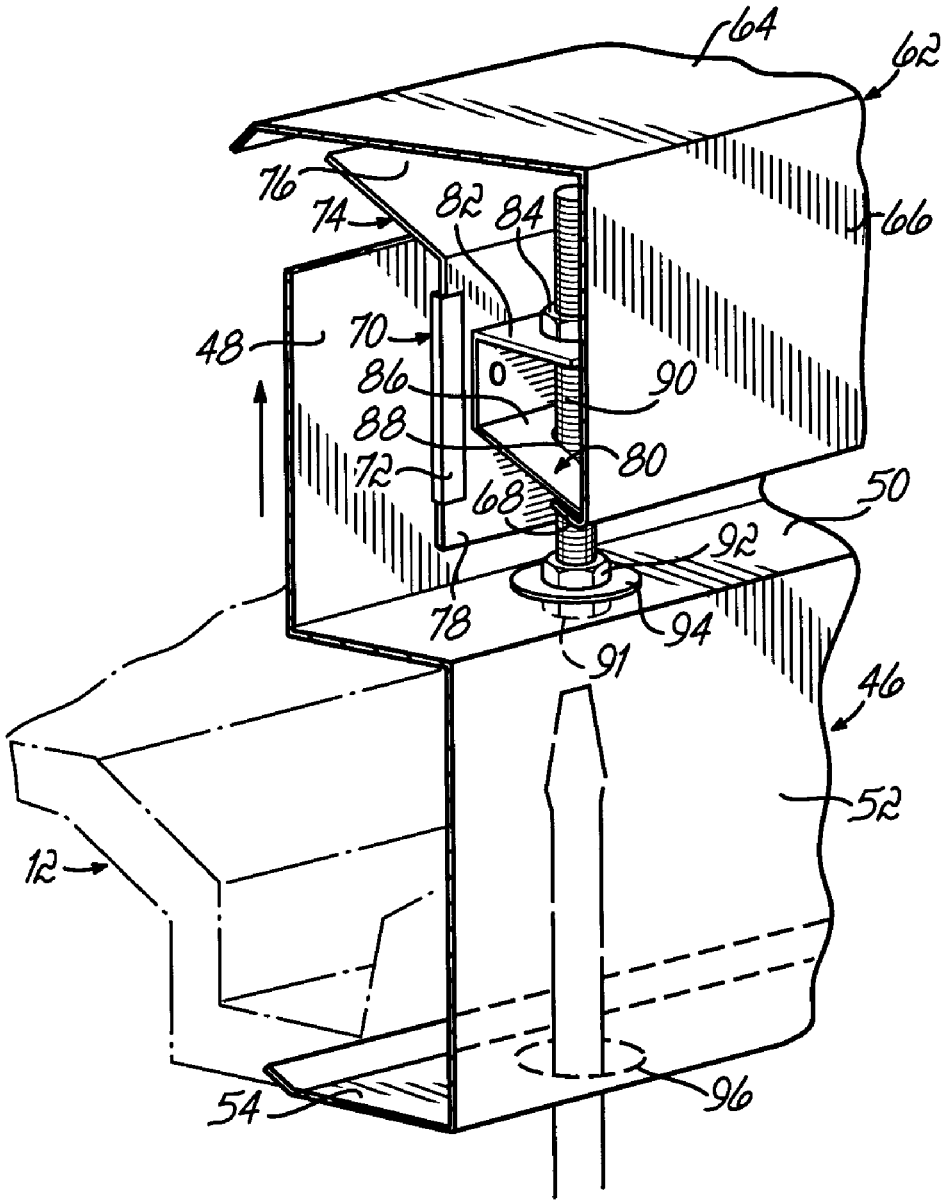
FIG. 9 is a perspective view of the case box and fastening system of FIG. 8 after an installer has adjusted the fastening system to raise the height of the case box.

Referring to FIGS. 8 and 9, the operation of adjustment mechanism 70 involves simply rotating threaded screw 90 clockwise or counterclockwise. Due to the attachment of screw 90 to case box 46 by nut 92 and washer 94, case box 46 is carried upwardly or downwardly depending on whether clockwise or counterclockwise rotation occurs. Screw 90 rotates through nut 84 and clip 80 and track 72, which is fixed to first side wall 48 of case box 46 moves upwardly or downwardly along bottom end 78 of tab 74. It will be appreciated that adjustment mechanism 70 may be duplicated at all necessary locations of case box 46, such as adjacent to the corners of case box 46 when case box 46 is square.

While preferred embodiments of the present invention has been detailed above, it will be understood that many modifications and substitutions for the specifically described embodiments may be made without departing from the spirit and scope of the invention. Applicant therefore does not intend to be bound by the details provided herein but only by the scope of the appended claims.

What is claimed is:

1. A ceiling panel system comprising:

a plurality of case boxes comprising a plurality of side panels and a lower decorative panel coupled together to form an interior space;

a fastening system attachable to a substructure, each of said case boxes engaging said fastening system by applying an upward force from below to achieve a snap fit between said fastening system and said case boxes; and height adjustment mechanisms coupled with said case boxes and configured to allow adjustment in the height of said case boxes after installation.

2. The ceiling panel system of claim 1, wherein the ceiling panels include a decorative concavity on lower surface thereof.

3. The ceiling panel system of claim 1, wherein the ceiling panels are made from at least one of wood, foam, plastic, metal, glass reinforced plastic, and fiberglass reinforced gypsum.

4. The ceiling panel system of claim 1, further comprising a facing strip covering a seam between adjacent decorative panels.

5. The ceiling panel system of claim 1, wherein said fastening system includes at least one deformable retaining tab.

6. A ceiling panel system comprising:

a substructure;

a plurality of ceiling panels; and a fastening system affixing said plurality of ceiling panels to said substructure by applying an upward force from below to achieve a snap fit connection; and a threaded fastener coupled to said ceiling panel and configured to allow adjustment in the spacing between said ceiling panels and said substructure.

7. A method of installing a ceiling panel system, the method comprising:

installing a first coupling member to a substructure associated with a ceiling;

coupling a ceiling panel to said first coupling member by achieving a snap fit between a second coupling member on the ceiling panel and the first coupling member in an upwardly directed motion; and turning a threaded fastener to adjust the distance between the ceiling panel and the first coupling member after achieving the snap fit connection.

8. The method of claim 7, wherein the substructure further comprises at least one of an existing ceiling, a truss, a framing member, and a rafter.

* * * * *